US006637512B2

(12) United States Patent
Casey

(10) Patent No.: US 6,637,512 B2
(45) Date of Patent: Oct. 28, 2003

(54) SOAP STICK LAUNCHER AND METHOD FOR LAUNCHING SOAP STICKS

(76) Inventor: Dan Casey, 211 Stubblefield Lake Rd., Huntsville, TX (US) 77340

( * ) Notice: Subject to any disclaimer, the term of this patent is extended or adjusted under 35 U.S.C. 154(b) by 0 days.

(21) Appl. No.: 09/898,963

(22) Filed: Jul. 3, 2001

(65) Prior Publication Data

US 2003/0010504 A1 Jan. 16, 2003

(51) Int. Cl.[7] ..... E21B 43/00

(52) U.S. Cl. ..... 166/310; 166/381; 166/400; 166/53; 166/75.15

(58) Field of Search ..... 166/400, 373, 166/381, 65.1, 66.4, 75.15, 70, 310, 53

(56) References Cited

U.S. PATENT DOCUMENTS

| | | | | |
|---|---|---|---|---|
| 4,785,880 A | | 11/1988 | Ashton | |
| 5,188,178 A | | 2/1993 | Noyes | |
| 5,515,924 A | | 5/1996 | Osterhoudt, III | |
| 5,813,455 A | | 9/1998 | Pratt et al. | |
| 6,039,122 A | * | 3/2000 | Gonzalez | 166/379 |
| 6,044,905 A | | 4/2000 | Harrison, III | |
| 6,056,058 A | | 5/2000 | Gonzalez | |
| 6,269,875 B1 | * | 8/2001 | Harrison et al. | 166/53 |

* cited by examiner

*Primary Examiner*—David Bagnell
*Assistant Examiner*—Jennifer H Gay
(74) *Attorney, Agent, or Firm*—D'Ambrosio & Associates PLLC

(57) ABSTRACT

A stick launcher and method for launching soap sticks into a gas or oil well. The stick launcher comprises a containment vessel adapted to house the soap sticks, the containment vessel comprising a contiguous wall and a top and a bottom. A turret-style separator is positioned within the containment vessel, the separator comprising blades, and adapted to contain the soap sticks between the blades of the turret-styled separator and the contiguous wall of the containment vessel. A ball valve is positioned adjacent the bottom of the containment vessel, the ball valve, when in open position, adapted to be in fluid communication with a well bore and the containment vessel. A rotating assembly, when set in motion by an actuator, is used to rotate the separator and simultaneously open or close the ball valve. The rotating assembly comprises a ratchet mechanism and an actuator plate that, while acting on the separator to advance a soap stick into position in the passage way, opens and closes the ball valve so that the containment vessel and soap sticks have minimal contact with the moisture laden fluids of the well bore.

21 Claims, 5 Drawing Sheets

35
62
68
65
64
25
80
31
67
83
30
70
85
82
50
84
60

SOAP STICK LAUNCHER AND METHOD FOR LAUNCHING SOAP STICKS

FIELD OF THE INVENTION

This invention relates to a soap stick launcher and method for launching soap sticks into gas, oil or other types of wells. More particularly, the present invention relates to the reduction of hydrostatic pressure caused by salt water migrating into well bores.

BACKGROUND OF INVENTION

The presence of water in oil and gas formations is problematic, especially if water migrates into the production tubing. When the hydrostatic pressure of the water column within a well bore overcomes the pressure of the formation fluids, production flow ceases. To counteract the hydrostatic pressure, surfactants in the form of soap sticks are periodically released into the well bore. The surfactants foam the water thereby reducing the hydrostatic pressure so that production from the formation can continue to flow again. Initially, soap sticks were dropped by hand into the well tubing. Methods or apparatus for automatically dropping soap sticks into oil and gas wells at periodic intervals have been used. Gonzalez, in U.S. Pat. No. 6,056,058, teaches a method and apparatus for automatically launching sticks of various materials into oil and gas wells. The apparatus has an enclosed magazine with several chambers containing soap sticks to be released into a well. The magazine is rotated by a double acting cylinder actuator in response to pressure alterations. A pneumatic ratchet means automatically rotates the shaft when a double acting cylinder actuator causes a rod to extend or retract. A solenoid alternates the pressure in response to a signal from a battery operated timer means, an automatic telephone dialing code, a low differential pressure, a low static pressure or changes in flow rate. The '058 device positions the ratchet means on top of the magazine housing. The '058 reference also teaches the use of a pressure equalizing line that bypasses the lower manual valve.

Harrison, U.S. Pat. No. 6,044,905, discloses a chemical stick storage and delivery system that utilizes a stacked dual valve system for allowing the chemical sticks to enter into the well bore. A battery-operated timer controls the operation of the stacked first and second valves. A rotatable chemical stick storage device is supported on top of a delivery tube. In one embodiment, when the first valve is opened, a chemical stick drops into a chamber, and when the second valve is opened, the stick drops from the chamber to the well. Both valves are slightly opened at the same time thereby allowing well gases or fluids to enter the stick storage chamber.

The Noyes U.S. Pat. No. 5,188,178, teaches a method and apparatus for automatic well stimulation that has a sequentially actuated magazine to allow a chemical stimulant to be dispense into the well. The '178 device uses a cylinder-type magazine mounted within an upper chamber to house the sticks within eight cylinders and a motor means to rotate the magazine. Pratt '455 discloses a chemical dispensing system and method for automatically dispensing chemical sticks into a well bore. The apparatus is a tubular receptacle with an upper storage section and a lower receiving chamber with sticks stacked end to end. The holding device and the receptacle valve are actuated by an actuating mechanism which includes a pneumatic solenoid valve. The valve regulates the flow of gas to a pneumatic cylinder for the holding device and a pneumatic cylinder which is part of the valve actuator for the bottom receptacle valve.

Soap sticks often disintegrate and melt while being stored in the magazine of automatic stick release devices. Moisture in well fluids that rise and fill the magazine disintegrates the soap sticks. Atmospheric heat conditions surrounding well sites can melt the soap. None of the above references adequately solve the problem of disintegration of soap sticks stored in their automatic stick release devices.

SUMMARY OF THE INVENTION

The present invention provides a stick launcher for launching soap sticks into a gas or oil well. The soap stick launcher and method of this invention avoids contamination from moisture present in the well bore by maintaining the storage container in a state of overpressure. The preferred soap stick launcher also uses a quick action ball valve system to reduce exposure of the soap sticks to moisture laden fluids from the well bore. Heat deterioration of the soap sticks is avoided by a cooling system which maintains the temperatures of the storage container approximately 10° F. to 60° F. below ambient temperatures. One preferred embodiment of the stick launcher comprises a compact containment vessel that is adapted to house soap sticks of various sizes and shapes. The containment vessel has a contiguous wall and a top and a bottom. The vessel further comprises a removable and sealable top plate and a bottom plate defining an opening. A turret-style separator sits within the containment vessel. This separator is constructed from a series of faceted blades that interlock to define a quill shape internal diameter and project a separation blade radially outward. The separator can be removable and rotatable. The separator is adapted to contain the soap sticks between the blades of the separator and the contiguous wall of the containment vessel. Because bulky cylinders are not required for each soap stick, the containment vessel can be compact and light weight.

Soap sticks tend to react with water, especially salt water. It is important that moisture-containing well fluids, gaseous or liquid, have minimal contact with the soap sticks. A ball valve is positioned adjacent the bottom of the containment vessel. The ball valve, when in open position, is adapted to be in fluid communication with a well bore and the containment vessel. Preferably, the bottom plate comprises a threaded connector. The opening in the bottom plate and the threaded connector define a passageway for the soap stick so that rotating the turret styled separator positions a soap stick immediately above the ball valve.

A rotating assembly, when set in motion by an actuator, is used to rotate the separator and simultaneously open or close the ball valve. Preferably, the rotating assembly comprises a ratchet mechanism and an actuator plate that, while acting on the separator to advance a soap stick into position in the passage way, opens and closes the ball valve so that the containment vessel, and the soap sticks within it, have minimal contact with the moisture laden fluids of the well bore.

Preferably, the ratchet mechanism comprises a pawl body, two or more pawls mounted on the pawl body, a ratchet arm and an actuator plate. The actuator plate is connected to the ball valve. The actuator plate is joined to the ratchet arm by a linkage. The pawl body comprises an upper section, a lower section and a middle section. The upper section and middle section are within the containment vessel and the lower section extends outside of the bottom plate. The pawls can be mounted on the upper section of the pawl body for engaging with and rotating the blades of the turret-style separator. The ratchet arm is mounted radially to the axis of the containment vessel for engagement with the lower section of the pawl body, so that rotation of the actuator plate opens the ball valve and moves the ratchet arm in a direction so as to disengage the pawls from the blades of the turret styled separator. In this way, a soap stick in the passage way drops through the ball valve into the well bore. Simultaneously, the disengagement of the pawls from the blades prevents rotation of the separator. Immediately after the soap stick drops through the ball valve, the actuator rotates the ratchet arm in an opposite direction to close off the ball valve and simultaneously advance another soap stick into the passage way.

In one embodiment, the actuator for rotating the rotating assembly is a gas cylinder mounted adjacent the containment vessel. Preferably, the gas cylinder is linked to the actuator plate for rotating the rotating assembly. In one preferred embodiment, the actuator plate comprises a first end, a second end and a middle, the first end attached to the ratchet arm, the middle attached to the ball valve and the second end linked to the gas cylinder. Preferably, the stick launcher further comprises an electronic controller for extending and retracting the gas cylinder so that extending the gas cylinder rotates the actuator plate in a first direction to open the ball valve and to simultaneously move the linkage connected to the ratchet arm so that the pawls disengage the blades of the separator. Retracting the gas cylinder rotates the actuator plate in an opposing direction to close the ball valve and simultaneously move the linkage connected to the ratchet arm so that blades of the separator re-engage the pawls to rotate the separator and advance another soap stick to the passage way above the ball valve.

In a preferred method for launching soap sticks into a gas or oil well, the method comprises:

a) loading soap sticks into a stick launcher comprising a containment vessel, a rotating assembly connected to an actuator for rotating the rotating assembly and a ball valve in fluid communication with a well bore. Preferably, the ball valve is joined to the rotating assembly. The containment vessel can have a removable top, a contiguous wall and a separator with blades, the blades in a clearance position relative to the contiguous wall so that the blades and the contiguous wall define a plurality of compartments;

b) positioning the soap sticks within the compartments. The bottom of the containment vessel defines an opening above the ball valve;

c) rotating the separator using the actuator and rotating assembly to rotate the separator in a first direction to advance a soap stick above the opening so that one stick falls through the opening and comes to rest on top of the ball valve;

d) closing the ball valve simultaneously to the rotation in step (c) by rotating the ball valve with the rotating assembly of step (c) to avoid well fluids from entering the containment vessel;

e) rotating the ball valve in a direction opposite to the first direction of step (c) to open the ball valve so that the soap stick drops into the well bore, while simultaneously disengaging the rotating mechanism from the separator to prevent the separator from rotating while the soap stick is dropping;

f) maintaining the containment vessel in an overpressure condition so that pressure from the containment vessel is exhausted while the ball valve is opened to avoid the inhalation of well fluids into the containment vessel.

In another preferred embodiment, the stick launcher for launching soap sticks comprises a cooling system to keep the containment vessel 10° F. to about 60° F. below ambient temperatures thereby further reducing the deterioration of the soap sticks.

It is noted that the drawings illustrate only some typical embodiments of the invention and are therefore not to be considered limiting of its scope, for the invention will admit to other equally effective embodiments.

DETAILED DESCRIPTION OF THE INVENTION

The present invention provides an automatic soap stick launcher for releasing soap sticks into an oil or gas well. Soap sticks are automatically dropped down into the production zone of a well to produce foam with water that has migrated into the wellbore from the formation. The automatic soapstick launcher of this invention holds a quantity of soap sticks in an array alignment within a turret-styled separator confined by the inner wall of a top-loading containment vessel. This invention embodies several advantageous structural systems to prevent contamination of the soap sticks from downhole moisture prior to use. The first is a system of reducing moisture leaks to the soap sticks within the containment vessel by automatically advancing each soapstick toward the bottom port of the containment vessel while automatically and quickly opening and closing a ball-type valve. The second is a system of maintaining the containment vessel in a condition of overpressure prior to exposure to wellbore fluids thereby discouraging the influx of wet gas from the wellbore into the containment vessel while the bottom port is opened. Because of overpressure, gases within the containment vessel are expelled when the ball valve is opened thereby preventing wellbore fluids from entering the containment vessel. After closure of the automated ball-type valve, the over-pressure process is restarted.

Gases piped into the containment vessel for the overpressure process are pre-conditioned to remove moisture to a level acceptable for the storage and use of the water-soluble soap sticks. This pre-conditioning creates a relatively dry well-gas atmosphere surrounding the soap sticks and is created by a moisture-removal method using a drying chamber that employs a pressure drop across an orifice. The collected moisture is piped out of the drying chamber. The as-dried atmosphere is maintained within the containment vessel by minimizing the exposure time to the wet wellbore gas because of the quick open-close action of the automated ball-type valve at the bottom of the vessel.

Figure 1:
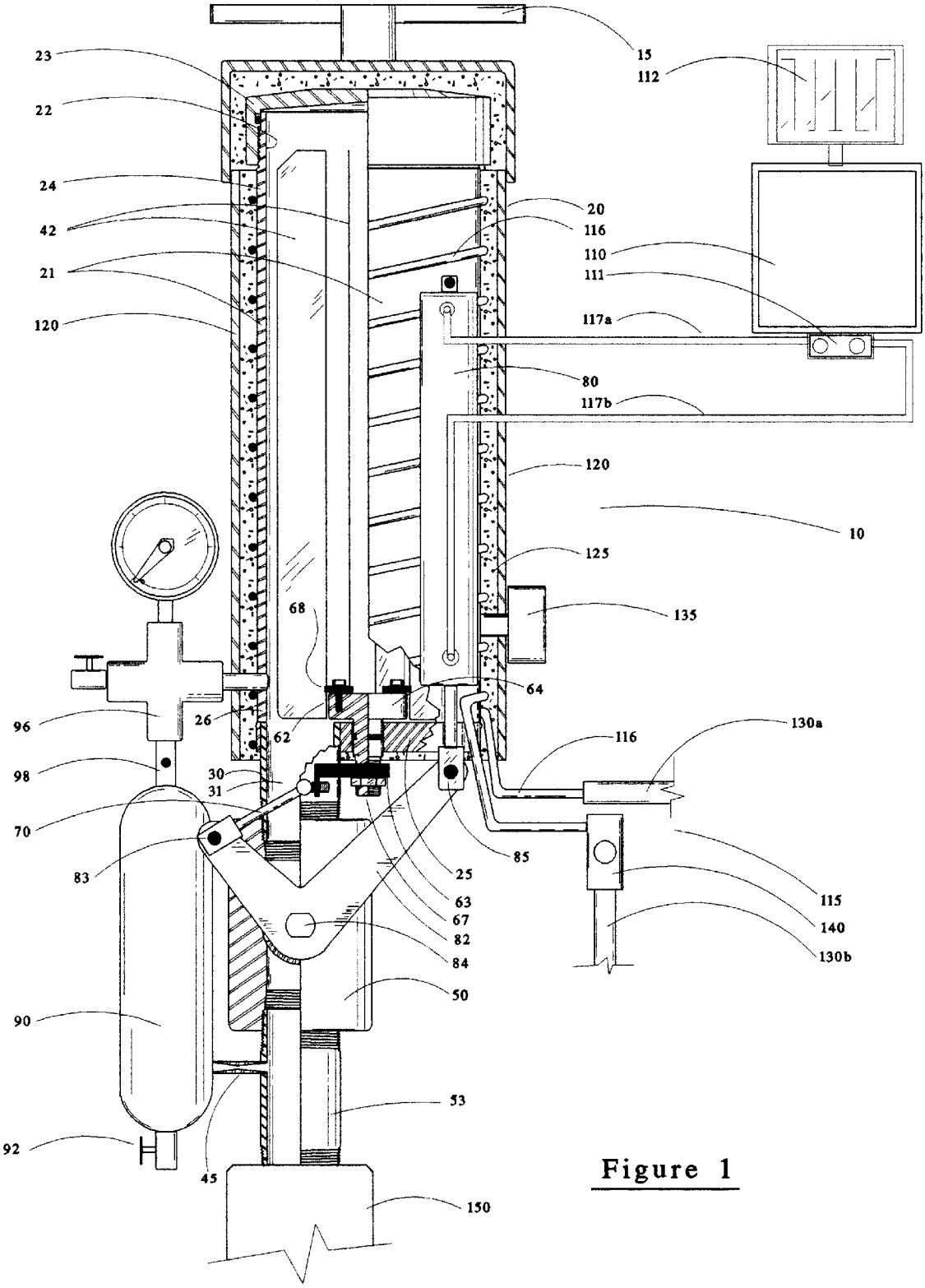
FIG. 1 is a cross-sectional view, partially in section, of one embodiment of the present invention.
Figure 5:
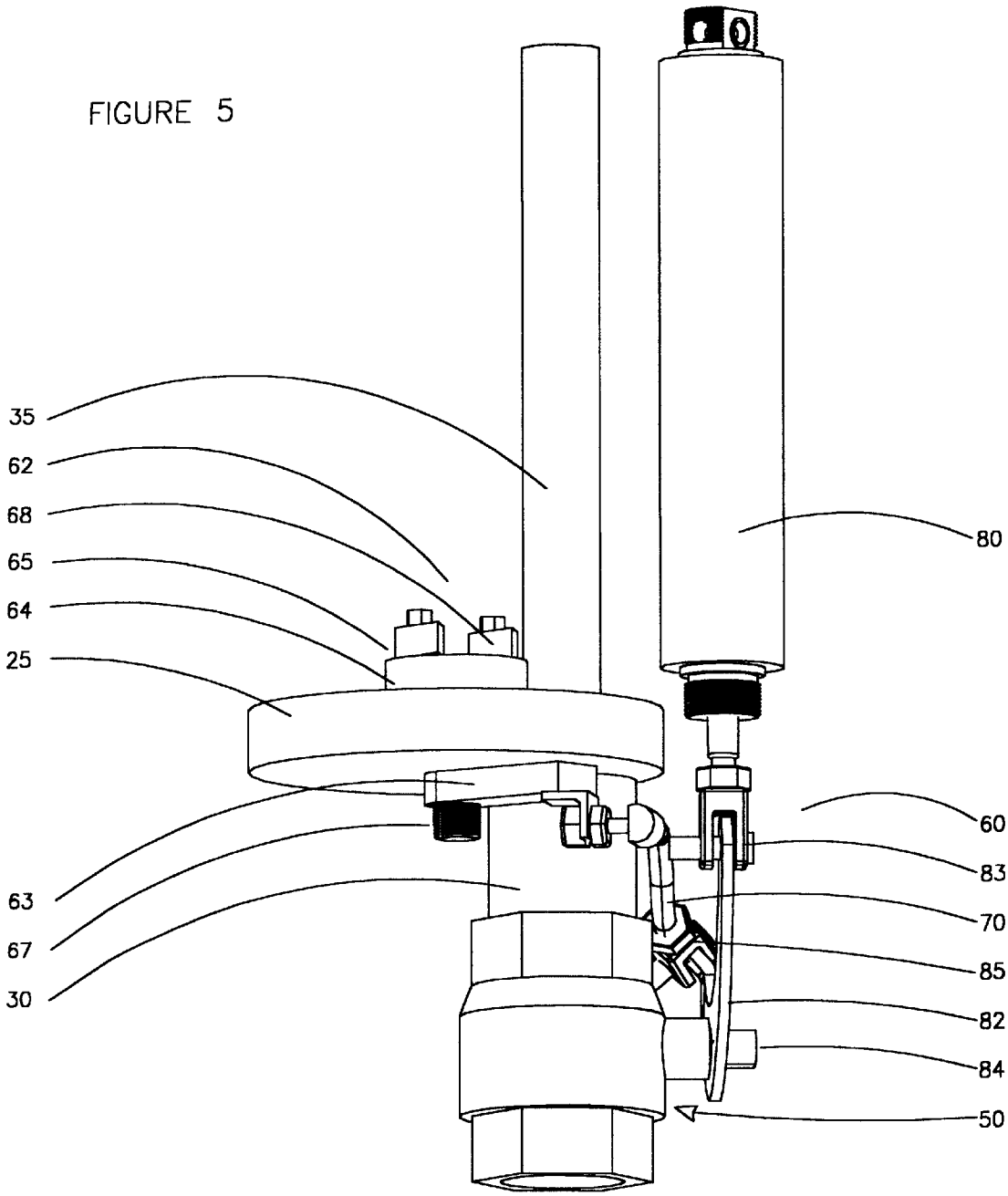
FIG. 5 is an exploded view of another perspective of the rotating assembly and actuator of one embodiment of this invention.

Referring to FIGS. 1, 5 and 6, the soap stick launcher 10 of one preferred embodiment of this invention comprises a containment vessel 20, a turret styled separator 40 within the containment vessel 20 for holding soap sticks between the blades 42 and an inner contiguous wall 22. A ball valve 50 is preferrably in communication between the containment vessel 20 and the well bore 150. The opening and closing of the ball valve 50 is effected by an actuator 80 which simultaneously opens the ball valve 50 and disengages a ratchet mechanism 62 so that a soap stick positioned in a passage way 31 immediately above the ball valve 50 drops through the open valve and into the well bore 150. The actuator 80 is quickly rotated in an opposite direction to close the ball valve 50 and engage the ratchet mechanism 62 thus advancing another soap stick 35 that drops into the passage way 31.

Figure 2:
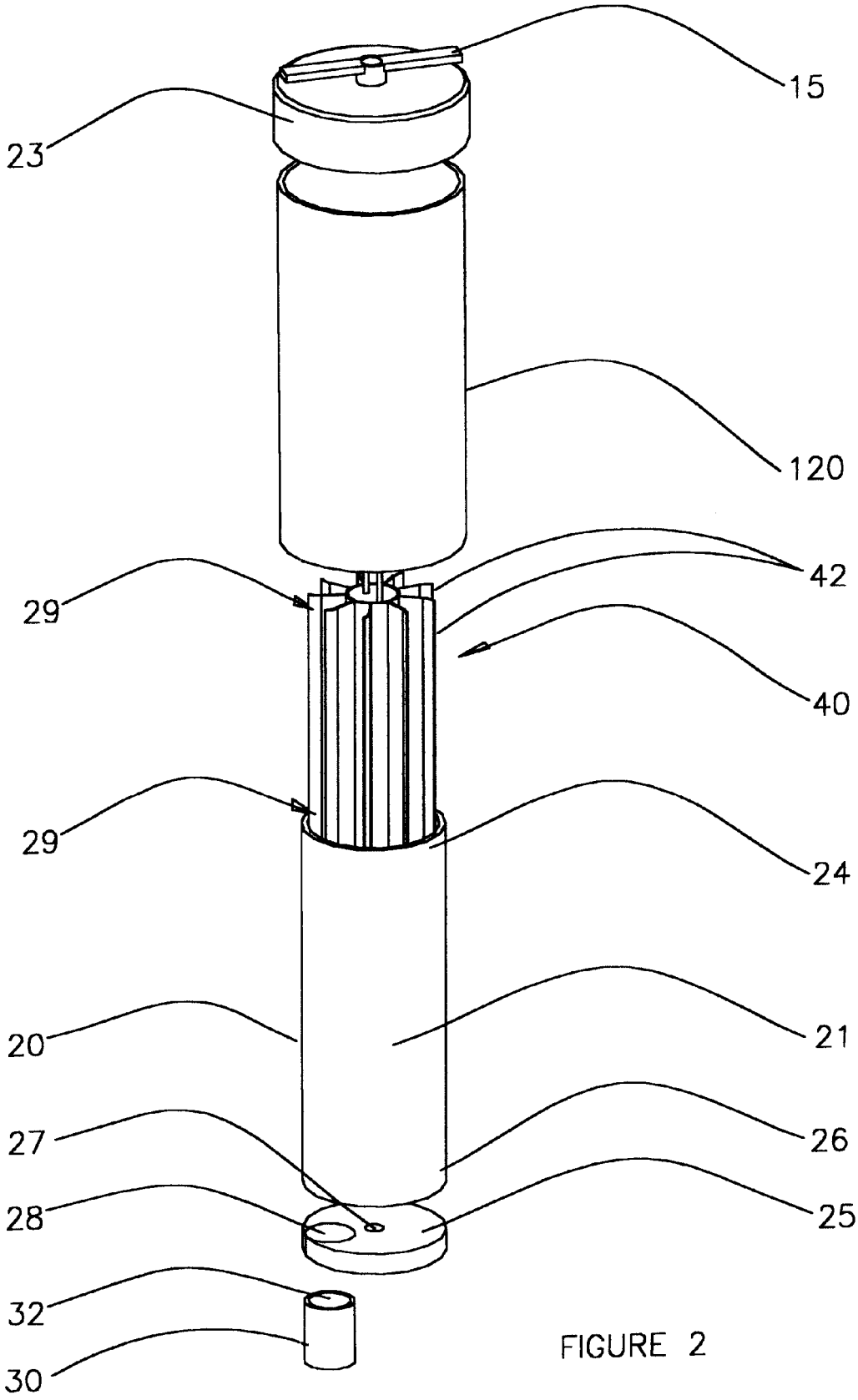
FIG. 2 is a three dimensional view of the containment vessel and separator.

As illustrated in FIG. 2, the containment vessel 20 is adapted to house the soap sticks and to that effect, comprises a contiguous wall having a top 24 and a bottom 26. A removable and sealable top plate 23 can be threaded onto the top 24 of the containment vessel 20. Preferably, the top plate 23 is dome shaped. Since the top plate 23 is removable by its handle 15, it is relatively easy to gain access to the inside of the containment vessel 20 to clean it and the separator 40 as well as load additional soap sticks. A bottom plate 25 closes off and seals the bottom 26. The bottom plate 25, illustrated in FIG. 2 defines an opening 28 aligned with the well bore 150 and also defines a hole 27 centrally aligned with the separator 40. Threaded to the bottom plate 25 at the opening 28 is a threaded connector 30. The opening 28 in the bottom plate 25 and a cavity 32 defined by the threaded connector 30 define a passage-way 31 for the soap stick so that rotating the rotating assembly 60 positions a soap stick 35 immediately above the ball valve 50. When the ball valve 50 is opened, the soap stick drops into the well bore 150.

As discussed earlier, the containment vessel 20 is maintained in a state of overpressure, overpressure meaning pressure greater than the pressure values within the well bore. Typically, well bore pressures surge during operations. The pressure surges of on shore wells can range from 100 psi to 500 psi. The overpressure state of the containment vessel is usually about 10 psi to 500 psi above mean well head pressure. To this end, the containment vessel 20 and its top plate 23 and bottom plate 25 are rated to withstand pressure values of up to 5000 psi, therefore, within the pressure surge ranges of most land wells. As depicted in FIG. 2, within the containment vessel 20 is a removable and rotatable turret-style separator 40 in axial alignment with the vessel 20. The separator 40 can be substantially equivalent in length to the vessel 20. A preferred separator 40 is constructed from a series of faceted blades 42 that interlock to define a quill shape internal diameter and project a separation blade 42 radially outward approximately to the inner wall of the containment vessel 20. The blades 42 are in a clearance position relative to the contiguous wall 22. The blades 42 and the contiguous wall 22 define a plurality of compartments 29 for receiving the soap sticks. The separator 40 is adapted to contain the soap sticks between the blades 42 and the contiguous wall 22 of the containment vessel 20. Soap sticks vary in diameter and shape. Because the inner contiguous wall 22 of the containment vessel 20 and blades 42 of the separator 40 are used to house various sized soap sticks, the containment vessel is more compact and lighter in weight than previous soap stick housing that required an enclosed cylinder for each soap stick.

Figure 3:
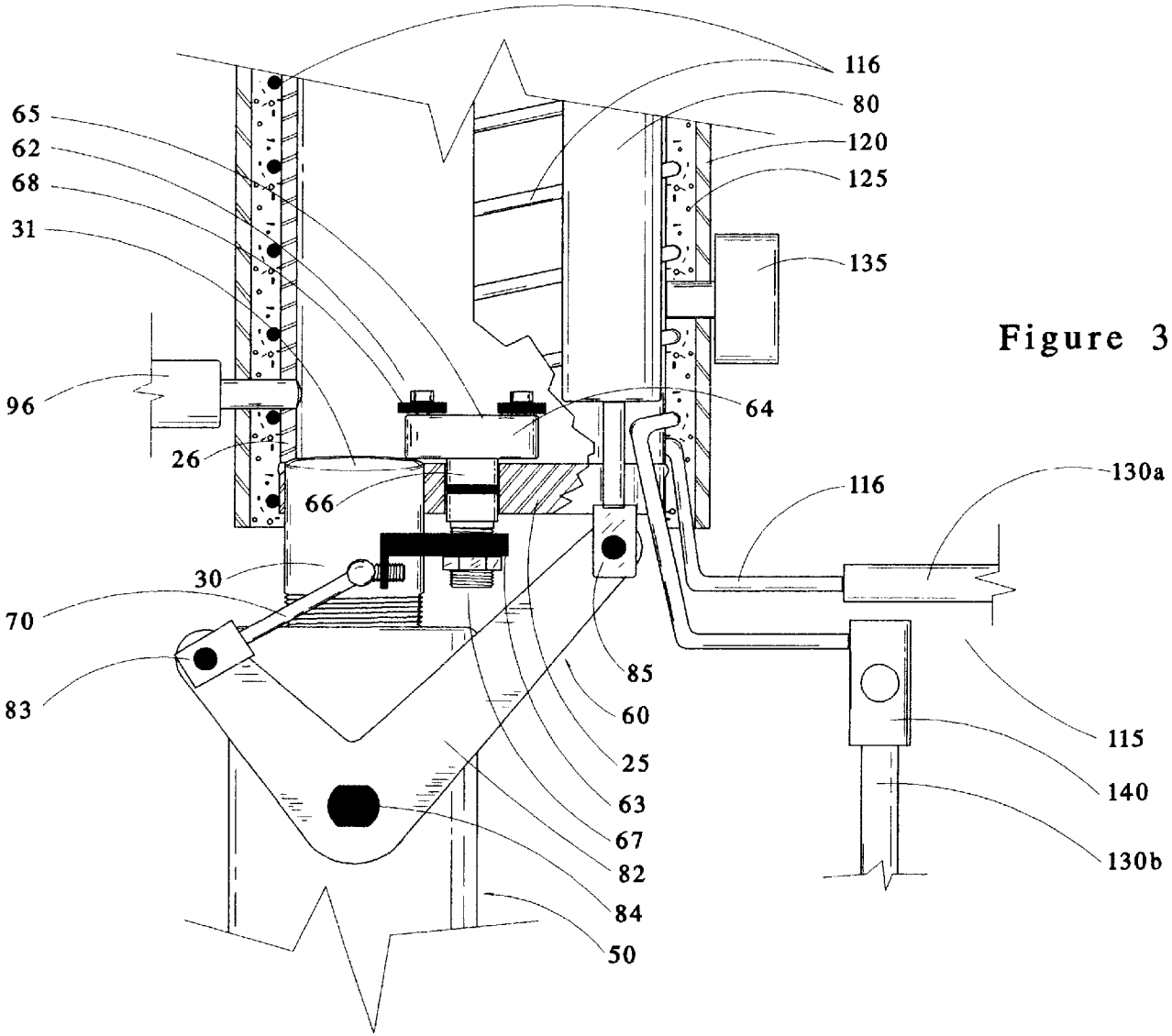
FIG. 3 is an exploded view of the ratchet mechanism as depicted in FIG. 1.
Figure 4:
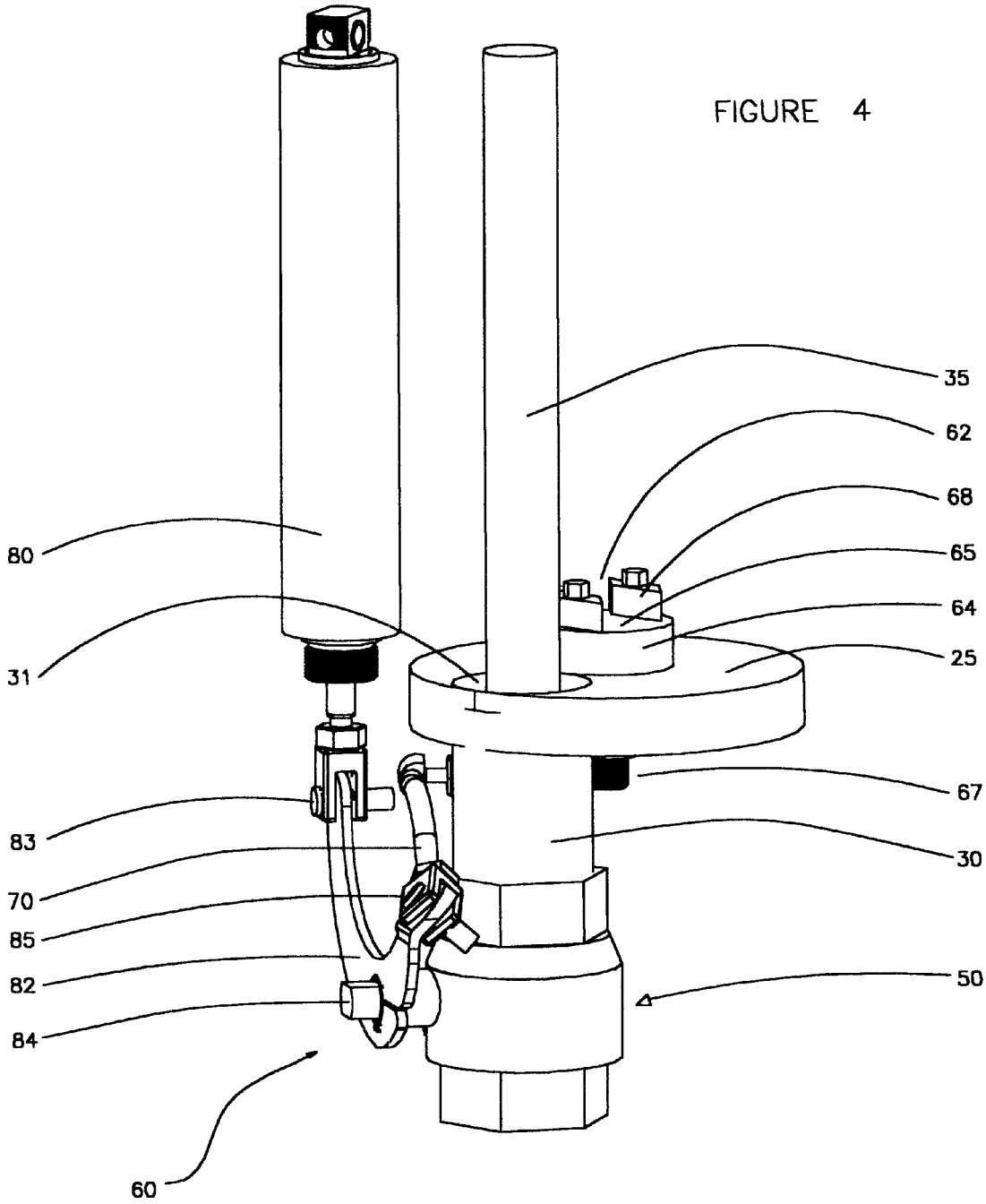
FIG. 4 is an exploded side view of the rotating assembly and actuator of one embodiment of this invention.

Preferably, the turret-styled separator 40 rests loosely over the central hole 27 in the bottom plate 25 oversetting the ratchet mechanism 62 that is part of the rotating assembly 60. The rotating assembly 60, when set in motion by an actuator 80, is used to rotate the separator 40 and simultaneously open or close the ball valve 50. Referring to FIGS. 3, 4 and 5, the preferred rotating assembly 60 comprises a ratchet mechanism 62 and an actuator plate 82 that, while acting on the separator 40 to advance a soap stick into position in the passage way 31, opens and closes the ball valve 50 so that the containment vessel 20 and soap sticks have minimal contact with the moisture laden fluids of the well bore 150. As seen in FIGS. 4 and 5, the actuator plate 82 comprises a first end 83, a second end 85 and a middle 84. The first end 83 is connected to the ratchet mechanism 62 and the middle 84 is fixedly attached to the ball valve 50.

An actuator 80 rotates the rotating assembly 60 by having the second end 85 of the actuator plate 82 linked to the actuator 80. Preferably, the ratchet mechanism 62 comprises a pawl body 64, two or more pawls 68 mounted on the pawl body 64, a ratchet arm 63 and an actuator plate 82. The actuator plate 82 is connected to the ball valve 50. The actuator plate 82 is joined to the ratchet arm 63 by a linkage 70.

As illustrated in FIGS. 4 and 5, the pawl body 64 comprises an upper section 65, a lower section 67 and a middle section 66. The upper section 65 is within the containment vessel 20 with the separator 40 oversetting the pawl body 64. The middle section 66 is positioned within the central hole 27 and makes a rotatable, elastomeric seal with the bottom plate 25. The lower section 67 extends outside of the bottom plate 25 through the central hole 27. The pawls 68 can be mounted on the upper section 65 of the pawl body 64 for engaging with and rotating the blades 42 of the turret-style separator 40.

The ratchet arm 63 is mounted radially to the axis of the containment vessel 20 for engagement with the lower section of the pawl body 67, so that rotation of the actuator plate 82 simultaneously opens the ball valve and moves the actuator plate 82 in a direction so as to disengage the pawls from the blades of the turret styled separator. In this way, a soap stick in the passage way 31 drops through the opened ball valve 50 into the well bore 150.

Simultaneously, the disengagement of the pawls 68 from the blades 42 prevents rotation of the separator 40. Immediately after the soap stick drops through the ball valve 50, the actuator 80 rotates the ratchet arm 63 in an opposite direction to close off the ball valve 50 and advance another soap stick into the passage way 31. Preferably, the ratchet mechanism 62, moving in conjunction with the actuator plate 82, simultaneously acts on the separator 40 to advance a soap stick into position in the passage way 31, while the actuator plate 82 rapidly closes the ball valve 50 so that the soap sticks within the containment vessel 20 have minimal contact with the moisture laden fluids of the well bore.

In one preferred embodiment, as illustrated in FIG. 1, the actuator 80 is a gas cylinder 80 mounted vertically and adjacent to the containment vessel 20. Preferably, the upper section of the gas cylinder 80 is attached to the containment vessel 20. As seen in FIGS. 4 and 5, the gas cylinder is linked to the second end 85 of the actuator plate 82 and provides the force for rotating the rotating assembly 60. According to FIG. 1, the stick launcher 10 of this embodiment further comprises an electronic controller 110 that is connected to the gas cylinder 80 by tubing lines 117*a*, 117*b*. The electronic controller is programmed to activate the gas cylinder 80 periodically during a 24 hour period. The electrical supply for the electronic controller 110 is a 6-volt battery with a solar panel re-charger 112 and is known in the art. Gas supplied from the well head is pressure-reduced so that a low pressure supply enters the solenoid valve 111. The solenoid valve 111 is controlled by the electronic controller 110. When opened, the low pressure supply motivates the gas cylinder 80 to extend and retract so that extending the gas cylinder 80 rotates the actuator plate 82 in a first direction to open the ball valve 50 for a time sufficient to allow a soap stick in the passage way 31 to fall into the well bore 150, and to simultaneously move the linkage 70 connected to the ratchet arm 63 so that the pawls 68 disengage the blades 42 of the separator 40. Retracting the gas cylinder 80 rotates the actuator plate 82 in an opposing direction to close the ball valve 50 and simultaneously move the linkage 70 connected to ratchet arm 63 so that blades of separator 42 re-engage the pawls 68 to rotate the separator 40. In one preferred embodiment, the extension of gas cylinder 80 rotates the actuator plate 82 about its middle section 84 through 90° of arc, thereby opening the ball valve 50. The shorter first end 83 of actuator plate 82 is simultaneously rotated and causes linkage 70 to move ratchet arm 63 through a 40° arc. The movement of ratchet arm 63 causes the pawl body 64 and pawls 68 to disengage the blades 42 of the separator 40 in a retrograde move. The timing is as follows:

| | |
|---|---|
| Time = 0 | Controller/Solenoid causes cylinder to extend, opening ball valve, retracting pawls. |
| Time = 15 seconds | Controller/Solenoid causes cylinder to retract, closing ball valve, advancing pawls, rotating vane assembly, positioning one soapstick over closed ball valve. |
| Time = X hours | Waiting period until next open cycle, pressure builds inside the containment vessel. |

The controller 110 by its actions holds the ball valve 50 open for a time sufficient to allow the soapstick immediately above the ball valve 50 to fall into the wellbore tubing 150. During this time period, the containment vessel 20 is exhausted of any overpressure that had accrued to it. By expelling gases, the containment vessel 20 does not inhale an excess of moisture-laden wellbore gases or fluid. The presence of the falling soap stick 35 in the passageway 31 is an additional hindrance to the influx of moisture-laden gases into the containment vessel 20. This action plus the quick closure of the ball valve 50 helps to avoid deterioration of the remaining soapsticks.

In this preferred embodiment, to close the ball valve 50, the controller 110 causes gas cylinder 80 to retract, which rotates actuator plate 82 through a negative 90° arc. This action closes the ball valve 50 and, by linkage 70, pulls ratchet arm 63, pawl body 64 and pawls 68 counterclockwise. The pawls 68 re-engage and rotate blades of the separator 42, which allows a new soapstick to advance to a position above ball valve 50. The soapstick drops onto ball valve 50 and is held thereon until the cycle begins again. In another embodiment of this invention, the actuator can be an electric motor that drives the actuator plate.

To avoid deterioration of the soap sticks from moisture within the well fluids, the stick launcher 10 of this invention utilizes two systems illustrated in FIG. 1. The first is a drying system to dry fluids before they enter the containment vessel 20 and second is a system to maintain the containment vessel 20 in a state of overpressure to prevent well fluids from entering it while the ball valve 50 is opened. The state of overpressure and drying of well fluids is achieve as follows: communication of wellbore gas and fluid into the containment vessel 20 is interrupted by the closed position of a ball-type valve 50. Threaded onto a lower end of the vertically mounted ball-type valve 50, distal from the containment vessel 20, is a threaded adapter 53. The threaded adapter 53 is of a size and shape to connect with standard wellhead connections.

In one preferred embodiment, illustrated in FIG. 1, the threaded adapter 53 is connected to a drying chamber 90 adjacent the ball valve 50. The threaded adapter 53 comprises a top section, bottom section and middle section. The middle section defines a threaded opening. Threaded into this opening is an orifice nipple 45 comprising a first end 45*a* and a second end 45*b*. Preferably, the first end of the orifice nipple 45*a* is threadedly connected to the threaded adapter 53. The second end of the orifice nipple 45*b* is threadedly connected to the drying chamber 90 adjacent the ball valve 50 so that well fluids enter the drying chamber 90 when the ball valve 50 is in a closed position. An orifice nipple 45 is a small diameter passage linking a high or low pressure zone, chamber or area with another zone, chamber or area of an identical or differing pressure. When wellhead gases flow from the threaded adapter 53 through the orifice nipple 45 and into the drying chamber 90, the restriction of the well gases passing through the orifice nipple 45 cause a pressure drop effect that will result in the removal of entrained moisture from the gas. These moisture droplets collect in the drying chamber 90. The drying chamber 90 further comprises an expulsion valve 92 for expelling water droplets so that moisture is expelled from the drying chamber 90.

A check valve 98 is positioned between the drying chamber 90 and the containment vessel 20 so that dried gases are released into the containment vessel 20 when the ball valve 50 is in the closed position and thereby maintaining the containment vessel in a condition of overpressure. In one preferred embodiment, the drying chamber 90 has a top, a bottom and a middle. The orifice nipple 45 is threaded into a port in the middle of the drying chamber 90. Threaded into the bottom is the moisture expulsion valve 92 through which water droplets are expelled. Threaded into the top of the drying chamber 90 is the check-type valve 98 through which dried gases are allowed to flow. The upper end of the check-type valve 98 is threaded into a manifold 96 that is threaded into the containment vessel 20. Pressure spikes occur during the course of a typical well-flow period. With the bottom ball valve 50 in a normally closed position, a pressure surge must pass through the orifice nipple 45, the drying chamber 90 and the check valve 98 to reach the containment vessel 20. Any pressure gained by the containment vessel 20 in this manner is held in place by check valve 98, creating the desirable condition of over-pressure.

In another preferred embodiment, the stick launcher for launching soap sticks comprises a cooling system 115 to keep the containment vessel 20 10° F. to about 60° F. below ambient temperatures thereby further reducing the deterioration of the soap sticks. Preferably, the containment vessel 20 comprises an outer wall 21. The outer wall 21 is wrapped in a cooling system 115 comprising cooling tubes 116 and insulation 125. The cooling system 115 further comprises a thermostat 135.

Preferably, the cooling tubes 116 are wrapped tightly in a spiral manner around the vessel and comprise a copper or other-type tube of small diameter. The number of revolutions of tubing is sufficient to make a thorough thermal contact between the copper tubing 116 and the containment vessel 20. An application of thermal transfer caulking insures complete thermal contact between the tubing and the vessel. Covering the outside of the spiral wrap tubing 116 and containment vessel 20 is a plastic or metallic outer covering 120 shaped to fit. Placed in the space between the outer wall 21 of the containment vessel 20 and the inside of the protective covering is foam, fiber or other-types of insulation 125. The two ends of the tubing exit the outer covering and are connected with tubing 130*a*, 130*b* of a larger diameter. The large diameter tubing 130*a*, 130*b* is of a diameter two to eight times larger than the small diameter cooling tube 116. Of the two large tubes, one is called the output side and is connected to the sales-line piping which is downstream of the wellhead. The other tube end, called the input side is connected to the wellhead tubing or, alternately, connected to the casing head. In operation, low volume, high-pressure gas from the wellhead tubing travels through the small diameter copper tubing, causing a pressure drop. This pressure drop has a cooling effect on the tubing 116 causing the tubing 116 to draw heat from the containment vessel 20 and thereby maintain a cooler internal atmosphere for the vessel 20 and its contents. The actions of the cooling system are controlled by the actions of a thermostat 135 acting on the solenoid valve 140 located in the input or output line of the cooling system. The sensing probe of the thermostat 135 is affixed between the containment vessel 20 and its insulation barrier 125.

In a preferred method for launching soap sticks into a gas or oil well, the method comprises: loading soap sticks 35 into a stick launcher 10 comprising a containment vessel 20, a rotating assembly 60 connected to an actuator 80 for rotating the rotating assembly 60 and a ball valve 50 in fluid communication with a well bore 150. Preferably, the ball valve 50 is joined to the rotating assembly 60. The containment vessel 20 has a removable top plate 23, a contiguous wall 22 and a separator 40 with blades 42. The blades 42 can be in a clearance position relative to the contiguous wall 22. The blades 42 and the contiguous wall 22 define a plurality of compartments 29.

The soap sticks are positioned within the compartments 29. One soap stick can be advanced to a position above an opening 28 in the bottom of the containment vessel 20 that is above the ball valve 50. To advance the soap stick, the separator 40 is rotated using the actuator 80 and rotating assembly 60 to rotate the separator in a first direction to advance a soap stick above the opening so that one stick falls through the opening 28 and comes to rest on top of the ball valve 50. The ball valve 50 is closed simultaneously to the rotation of the separator 40 by rotating the ball valve 50 with the rotating assembly 60 to avoid well fluids from entering the containment vessel 20 while a soap stick is advancing.

Rotating the ball valve 50 in a direction opposite to the first direction opens the ball valve 50 so that the soap stick drops into the well bore 150, while simultaneously disengaging the ratchet mechanism 62 from the separator 40 to prevent the separator 40 from rotating while soap stick is dropping. The containment vessel 20 is in an overpressure state so that pressure from the containment vessel 20 is exhausted while the ball valve 50 is opened to avoid the inhalation of well fluids into the containment vessel 20.

The rotating assembly 60 of this preferred method comprises a pawl body 64, two or more pawls 68 mounted on the pawl body 64, a ratchet arm 63 and an actuator plate 82 connected to the ball valve 50 and joined to the ratchet arm 63 by a linkage 70. The pawl body 64 comprises an upper section 65, a lower section 67 and a middle section 66. The separator rests on the pawl body 64. Preferably, the pawls 68 are mounted on the upper section 65 of the pawl body for engaging with and rotating the blades 42 of the separator 40. The ratchet arm 63 can be mounted radially to the axis of the containment vessel 20 for engagement with the lower section 67 of the pawl body so that rotation of the actuator plate 82 rotates the ball valve 50 and simultaneously moves the separator. In one embodiment, the actuator 80 comprises a gas cylinder 80 mounted adjacent the containment vessel 20, the gas cylinder 80 is linked to the actuator plate 82.

One preferred method of this invention further comprises the steps of extending and retracting the gas cylinder 80. The step of extending the gas cylinder 80 rotates the actuator plate 82 in a first direction to open the ball valve 50 connected to the actuator plate 82 and to simultaneously rotate the linkage 70 connected to the ratchet arm 63 so that the pawls 68 disengage the blades 42 of the separator. The step of retracting the gas cylinder 80 rotates the actuator plate 82 in an opposing direction to close the ball valve 50 and simultaneously rotate the linkage 70 connected to ratchet arm 63 so that blades 42 of separator re-engage the pawls 68 to rotate the separator 40. The steps of extending and retracting the gas cylinder 80 can be controlled by an electronic controller 110.

The foregoing description is illustrative and explanatory of preferred embodiments of the invention and variations in the size, shape, materials and other details will become apparent to those skilled in the art. It is intended that all such variations and modifications which fall within the scope and spirit of the appended claims be embraced thereby.

What is claimed is:

1. A method for launching soap sticks into a gas or oil well, the method comprising:

a) loading soap sticks into a stick launcher comprising a containment vessel, a rotating assembly connected to an actuator for rotating the rotating assembly and a ball valve in fluid communication with a well bore, the ball valve joined to the rotating assembly, the containment vessel having a removable top, a contiguous wall and a separator with blades, the blades in a clearance position relative to the contiguous wall, the blades and the contiguous wall defining a plurality of compartments;

b) positioning the soap sticks within the compartments, the bottom of the containment vessel defining an opening above the ball valve;

c) rotating the separator using the actuator and rotating assembly to rotate the separator in a first direction to advance a soap stick above the opening so that one stick falls through the opening and comes to rest on top of the ball valve;

d) closing the ball valve simultaneously to the rotation in step (c) by rotating the ball valve with the rotating assembly of step (c) to avoid well fluids from entering the containment vessel;

e) rotating the ball valve in a direction opposite to the first direction of step (c) to open the ball valve so that the soap stick drops into the well bore, while simultaneously disengaging the rotating mechanism from the separator to prevent separator from rotating while soap stick is dropping;

f) maintaining the containment vessel in an overpressure condition so that pressure from the containment vessel is exhausted while the ball valve is opened to avoid the inhalation of well fluids into the containment vessel.

2. The method of claim 1 wherein the rotating assembly comprises a pawl body, two or more pawls mounted on the pawl body, a ratchet arm and an actuator plate connected to the ball valve and joined to the ratchet arm by a linkage, the pawl body comprising an upper section, a lower section and a middle section, the separator resting on the pawl body, the pawls mounted on the upper section of the pawl body for engaging with and rotating the blades of the separator and the ratchet arm mounted radially to the axis of the containment vessel for engagement with the lower section of the pawl body so that rotation of the actuator plate rotates the ball valve according to steps (c) and (d) and simultaneously rotates the separator according to step (c).

3. The method of claim of claim 1 wherein the actuator comprises a gas cylinder mounted adjacent the containment vessel, the gas cylinder linked to the actuator plate.

4. The method of claim of claim 3 further comprising the steps of extending and retracting the gas cylinder wherein the step of extending the gas cylinder rotates the actuator plate in a first direction to open the ball valve connected to the actuator plate and to simultaneously move the linkage connected to the ratchet arm so that the pawls disengage the blades of the separator, and the step of retracting the gas cylinder rotates the actuator plate in an opposing direction to close the ball valve and simultaneously move the linkage connected to the ratchet arm so that the blades of the separator re-engage the pawls to rotate the separator.

5. The method of claim of claim 4 wherein the steps of extending and retracting the gas cylinder are controlled by an electronic controller.

6. A stick launcher for launching soap sticks into a gas or oil well, the stick launcher comprising:

a containment vessel adapted to house the soap sticks, the containment vessel comprising a contiguous wall having a top and a bottom;

a turret-style separator within the containment vessel, the separator comprising blades, the separator adapted to contain the soap sticks between the blades of the turret-styled separator and the contiguous wall of the containment vessel;

a ball valve positioned adjacent the bottom of the containment vessel, the ball valve, when in open position, adapted to be in fluid communication with a well bore and the containment vessel;

a rotating assembly comprising a ratchet mechanism and an actuator plate, the ratchet mechanism for rotating the turret-styled separator, the actuator plate comprising a first end, a second end and a middle, the first end connected to the ratchet mechanism and the middle fixedly attached to the ball valve;

an actuator for rotating the rotating assembly, the second end of the actuator plate linked to the actuator.

7. The stick launcher of claim 6 wherein the containment vessel further comprises a removable and sealable top plate and a bottom plate comprising a threaded connector, the bottom plate and threaded connector defining a passage-way for the soap stick so that rotating the rotating assembly positions a soap stick immediately above the ball valve.

8. A stick launcher for launching soap sticks into a gas or oil well, the stick launcher comprising:

a containment vessel adapted to house the soap sticks, the containment vessel comprising a contiguous wall having a top and a bottom;

a removable turret-style separator within the containment vessel, the separator comprising blades, the separator adapted to contain the soap sticks between the blades of the turret-styled separator and the contiguous wall of the containment vessel;

a ball valve positioned adjacent the bottom of the containment vessel, the ball valve, when in open position, adapted to be in fluid communication with a well bore and the containment vessel;

a rotating assembly comprising a ratchet mechanism and an actuator plate, the ratchet mechanism for rotating the turret-styled separator, the actuator plate comprising a first end, a second end and a middle, the first end connected to the ratchet mechanism and the middle fixedly attached to the ball valve;

an actuator for rotating the rotating assembly, the second end of the actuator plate linked to the actuator.

9. A stick launcher for launching soap sticks into a gas or oil well, the stick launcher comprising:

a containment vessel adapted to house the soap sticks, the containment vessel comprising a contiguous wall having a top and a bottom;

a turret-style separator within the containment vessel, the separator comprising blades, the separator adapted to contain the soap sticks between the blades of the turret-styled separator and the contiguous wall of the containment vessel;

a ball valve positioned adjacent the bottom of the containment vessel, the ball valve, when in open position, adapted to be in fluid communication with a well bore and the containment vessel;

a rotating assembly comprising a ratchet mechanism and an actuator plate, the ratchet mechanism for rotating the turret-styled separator, the actuator plate comprising a first end, a second end and a middle, the first end connected to the ratchet mechanism and the middle fixedly attached to the ball valve, the ratchet mechanism comprising a pawl body, the pawl body comprising an upper section, a lower section and a middle section, the ratchet mechanism further comprising two or more pawls mounted on the upper section of the pawl body for engaging with and rotating the blades of the turret-style separator and the lower section extending outside of the bottom plate;

an actuator for rotating the rotating assembly, the second end of the actuator plate linked to the actuator.

10. The stick launcher of claim 9 wherein the ratchet mechanism further comprises a ratchet arm mounted radially to the axis of the containment vessel for engagement with the lower section of the pawl body, the ratchet mechanism further comprising linkage for engaging the ratchet arm with the first end of the actuator plate so that rotation of the actuator plate rotates both the ratchet arm and the pawl body when the pawl body is engaged with the ratchet arm.

11. The stick launcher of claim 9 wherein the actuator comprises a gas cylinder mounted adjacent the containment vessel, the gas cylinder linked to the second end of the actuator plate.

12. The stick launcher of claim 11 further comprising an electronic controller for extending and retracting the gas cylinder so that extending the gas cylinder rotates the actuator plate in a first direction to open the ball valve connected to the middle of the actuator plate and to simultaneously move the linkage connected to the ratchet arm so that the pawls disengage the blades of the separator, and retracting the gas cylinder rotates the actuator plate in an opposing direction to close the ball valve and simultaneously move the linkage connected to ratchet arm so that the blades of the separator re-engage the pawls to rotate the separator.

13. The stick launcher of claim 12 wherein the actuator comprises an electric motor.

14. A stick launcher for launching soap sticks into a gas or oil well, the stick launcher comprising:

a containment vessel adapted to house the soap sticks, the containment vessel comprising a contiguous wall having a top and a bottom;

a turret-style separator within the containment vessel, the separator comprising blades, the separator adapted to contain the soap sticks between the blades of the turret-styled separator and the contiguous wall of the containment vessel;

a ball valve positioned adjacent the bottom of the containment vessel, the ball valve, when in open position, adapted to be in fluid communication with a well bore and the containment vessel;

a rotating assembly comprising a ratchet mechanism and an actuator plate, the ratchet mechanism for rotating the turret-styled separator, the actuator elate comprising a first end, a second end and a middle, the first end connected to the ratchet mechanism and the middle fixedly attached to the ball valve;

an actuator for rotating the rotating assembly, the second end of the actuator plate linked to the actuator; and a drying chamber adjacent the ball valve, a threaded adapter threaded onto the lower end of the ball valve, an orifice nipple having a first end and a second end, the first end threadedly connected to the threaded adapter, the second end of the orifice nipple threadedly connected to the drying chamber so that well fluids enter the drying chamber when the ball valve is in a closed position.

15. The stick launcher of claim 14 wherein the drying chamber comprises an expulsion valve for expelling water droplets and a check valve between the drying chamber and the containment vessel so that dried fluids are transferred into the containment vessel when the ball valve is in closed position thereby maintaining the containment vessel in a condition of overpressure.

16. A stick launcher for launching soap sticks into a gas or oil well, the stick launcher comprising:

a containment vessel adapted to house the soap sticks, the containment vessel comprising a contiguous wall having a top and a bottom, the containment vessel comprising an outer wall, the outer wall wrapped in a cooling system, the cooling system comprising cooling tubes and insulation so that the temperature within the containment vessel is maintained at a range of about 10° F. to about 60° F. below ambient temperatures;

a turret-style separator within the containment vessel, the separator comprising blades, the separator adapted to contain the soap sticks between the blades of the turret-styled separator and the contiguous wall of the containment vessel;

a ball valve positioned adjacent the bottom of the containment vessel, the ball valve, when in open position, adapted to be in fluid communication with a well bore and the containment vessel;

a rotating assembly comprising a ratchet mechanism and an actuator plate, the ratchet mechanism for rotating the turret-styled separator, the actuator plate comprising a first end, a second end and a middle, the first end connected to the ratchet mechanism and the middle fixedly attached to the ball valve;

an actuator for rotating the rotating assembly, the second end of the actuator plate linked to the actuator; and

17. The stick launcher of claim 16 wherein the cooling system further comprises a thermostat.

18. A stick launcher for launching soap sticks into a gas or oil well, the stick launcher comprising:

a containment vessel adapted to house the soap sticks, the containment vessel comprising a contiguous wall having a top and a bottom, the containment vessel further comprising a removable and sealable top plate and a bottom plate;

a removable and rotatable turret-style separator within the containment vessel, the separator comprising blades, the separator adapted to contain the soap sticks between the blades of the separator and the contiguous wall of the containment vessel;

a ball valve positioned adjacent the bottom of the containment vessel, the ball valve, when in open position, adapted to be in fluid communication with a well bore and the containment vessel;

a rotating assembly comprising a pawl body, two or more pawls mounted on the pawl body, a ratchet arm and an actuator plate connected to the ball valve and joined to the ratchet arm by a linkage, the pawl body comprising an upper section, a lower section and a middle section, the upper section and middle section within the containment vessel and the lower section extending outside of the bottom plate, the pawls mounted on the upper section of the pawl body for engaging with and rotating the blades of the turret-style separator and the ratchet arm mounted radially to the axis of the containment vessel for engagement with the lower section of the pawl body, so that rotation of the actuator plate opens the ball valve and moves the ratchet arm in a direction so as to disengage the pawls from the blades of the turret styled separator;

a gas cylinder mounted adjacent the containment vessel, the gas cylinder linked to the actuator plate for rotating the rotating assembly;

and a drying chamber for maintaining the containment vessel in a state of overpressure.

19. The stick launcher of claim 18 wherein the bottom plate comprising a threaded connector, the bottom plate and threaded connector defining a passage-way for the soap stick so that rotating the rotating assembly positions a soap stick immediately above the ball valve.

20. The stick launcher of claim 18 wherein the actuator plate comprises a first end, a second end and a middle, the first end attached to the ratchet arm, the middle attached to ball valve and the second end linked to the gas cylinder, the stick launcher further comprising an electronic controller for extending and retracting the gas cylinder so that extending the gas cylinder rotates the actuator plate in a first direction to open the ball valve and to simultaneously move the linkage connected to the ratchet arm so that the pawls disengage the blades of the separator, and retracting the gas cylinder rotates the actuator plate in an opposing direction to close the ball valve and simultaneously move the linkage connected to ratchet arm so that blades of separator re-engage the pawls to rotate the separator.

21. A method for launching soap sticks into a gas or oil well, the method comprising:

a) loading soap sticks into a stick launcher comprising a containment vessel and a separator with blades, the blades in a clearance position relative to the contiguous wall, the blades and the contiguous wall defining a plurality of compartments;

b) positioning the soap sticks within the compartments, the bottom of the containment vessel defining an opening above the ball valve;

c) rotating the separator so that one stick falls through the opening and comes to rest on top of the ball valve;

d) closing the ball valve simultaneously to the rotation in step (c) to avoid well fluids from entering the containment vessel;

e) rotating the ball valve in a direction opposite to the first direction of step (c) to open the ball valve so that the soap stick drops into the well bore, while simultaneously disengaging the rotating mechanism from the separator to prevent separator from rotating while soap stick is dropping;

f) maintaining the containment vessel in an overpressure condition so that pressure from the containment vessel is exhausted while the ball valve is opened to avoid the inhalation of well fluids into the containment vessel.

* * * * *